United States Patent [19]

Turner

[11] 4,187,953

[45] Feb. 12, 1980

[54] SECURITY CONTAINER AND CLOSURE APPARATUS

[75] Inventor: Lloyd S. Turner, Los Gatos, Calif.

[73] Assignee: Basic Products Development Company, Inc., Hayward, Calif.

[21] Appl. No.: 906,970

[22] Filed: May 18, 1978

[51] Int. Cl.[2] ..... B65D 17/00; B65D 39/00; B65D 43/04

[52] U.S. Cl. ..... 215/301; 215/321; 220/281; 220/306

[58] Field of Search ..... 215/301, 321, 206, 224; 220/281, 306

[56] References Cited

U.S. PATENT DOCUMENTS

| | | | |
|---|---|---|---|
| 1,554,745 | 9/1925 | McMann | 215/321 |
| 2,830,722 | 4/1958 | Darmstadt | 215/321 |
| 3,484,016 | 12/1969 | Turner | 215/301 |
| 3,830,393 | 8/1974 | Schrefer | 215/321 |

FOREIGN PATENT DOCUMENTS

| | | | |
|---|---|---|---|
| 555126 | 4/1958 | Canada | 215/301 |
| 327109 | 5/1918 | Fed. Rep. of Germany | 215/301 |
| 1168282 | 12/1958 | France | 215/321 |
| 304348 | 3/1955 | Switzerland | 215/321 |
| 1282754 | 7/1972 | United Kingdom | 215/321 |

*Primary Examiner*—George T. Hall
*Attorney, Agent, or Firm*—Claude A. S. Hamrick

[57] ABSTRACT

An improved security container and closure apparatus including a generally cylindrical container having a closing base portion at one end and an open mouth at the other end, a rib extending inwardly from the side of the mouth opening, and a neck portion surrounding the mouth and having an external wall provided with a circumscribing recess, and a resilient closure having a top portion and a surrounding, downwardly depending skirt portion, the skirt portion having an inwardly extending bead matingly engageable with the recess of the neck portion of the container. The top portion of the closure contacts the inwardly extending rib so that when downward pressure is applied to the top central portion of the closure, the rib acts as the fulcrum point of a lever to raise a segment of the skirt proximate the rib portion upwardly and out of plane such that a segment of the closure bead is caused to be forced out of the container recess thereby disengaging the mating relationship and leaving the closure resting loosely on top of the container after pressure is relieved.

18 Claims, 22 Drawing Figures

SECURITY CONTAINER AND CLOSURE APPARATUS

BACKGROUND OF THE INVENTION

1. Field of the Invention

This invention relates generally to security container and closure apparatus and more particularly to an improved container and associated closure which may be removed from the container only by applying pressure to a predetermined location thereof.

2. Description of the Prior Art

Containers of the type utilizing a flexible, plastic, snap-on safety closure are well known. For instance, U.S. Pat. No. 3,484,016 of Lloyd S. Turner discloses a container wherein a crowned closure is provided with a skirt having an inwardly extending bead which is adapted to lodge in an annular recess provided around the mouth of the container so that when the closure is applied to the container, the inwardly extending bead of the skirt lockingly engages the recess. The top surface of the neck of the container is provided with a continuous annular surface which functions as a fulcrum such that when downward pressure is applied to the center of the closure, the skirt is caused to increase in diameter and raise upwardly. This simultaneous expanding and raising action of the skirt expands and lifts the bead out of and then above the recess thereby unlocking the closure and disposing it on top of the container.

Although the patented closure works very well in most environmental situations, depending upon the type of material used, it may not be well-suited for applications in which the ambient temperature is substantially lower than typical room temperature since the flexibility of the plastic closure is reduced to such an extent that the skirt will not readily expand to allow disengagement from the recess when normal opening pressure is applied to the top center of the closure.

Another disadvantage of the prior art is that the various required recesses and projections around the mouth of the container usually preclude manufacturers from using certain inexpensive injection molding techniques.

SUMMARY OF THE PRESENT INVENTION

It is therefore an object of this invention to provide a security container and snap-on closure, the operation of which is relatively unaffected by cold temperature.

A further object of this invention is to provide a security container which may be made using simple injection molding techniques.

Another object of the present invention is to provide a security container and closure having a novel opening mechanism.

These objects have been met by a container including a neck portion having a locking recess formed thereabout, and a rib extending radially inwardly into the container's mouth to form a bearing or fulcrum surface; and a resilient closure including a top portion and a surrounding downwardly depending skirt portion, the skirt portion having an inwardly extending bead for lockingly engaging the recess of the neck portion. When downward pressure is applied to the central upper surface of the closure, the top bearing surface of the rib is contacted at a point near the outer edge of the top portion of the closure and acts as a fulcrum to cause a small portion of the skirt to be deformed out of plane and lifted above the locking recess. When the pressure applied to the closure is released, the remainder of the bead is caused to spring out of alignment and engagement with the recess as the stresses in the closure are relaxed and the closure returns to its original shape.

An important advantage of the present invention is that the closure, in being deformed out of plane to force only a portion of the bead out of and above the recess of the container, need not expand its entire circumference to force the bead from the recess, as in prior inventions of this type.

Another important advantage of the present invention is that the use of the rib as a fulcrum makes it possible to manufacture the container using relatively simple molds.

These and other objects and advantages will no doubt become apparent to those skilled in the art after reading the following detailed description which makes reference to the several figures of the drawing.

IN THE DRAWING

FIG. 1 is a partially broken perspective view of a container and a disengaged closure in accordance with the present invention;

FIG. 2*a* is a top plan view of the container shown in FIG. 1;

FIG. 2*b* is a sectional view of the container taken along the line 2*b*—2*b* of FIG. 2*a;*

FIG. 3*a* is a bottom plan view of the closure shown in FIG. 1;

FIG. 3*b* is a sectional view of the closure taken along line 3*b*—3*b* of FIG. 3*a;*

FIG. 4 is a partial cross-sectional view of the container and closure shown in FIG. 1 with the closure in the engaged position;

FIG. 5*a* is a perspective view illustrating the method of removal of the closure from the container;

FIGS. 5*b* and 5*c* are cross-sectional views further illustrating the closure opening operation;

FIG. 6*a* is a partially broken perspective view of a first alternative embodiment for a container in accordance with the present invention;

FIG. 6*b* is a perspective view of another alternate embodiment for a container in accordance with the present invention;

FIG. 7 is a cross-sectional view of a second alternative embodiment for a container and closure in accordance with the present invention;

FIG. 8*a* is a bottom plan view of a third alternative embodiment of a closure in accordance with the present invention;

FIG. 8*b* is a sectional view taken along the line 8*b*—8*b* of FIG. 8*a;*

FIG. 8*c* is a bottom plan view of another alternative embodiment of a closure in accordance with the present invention;

FIG. 8*d* is a sectional view taken along line 8*d*—8*d* of FIG. 8*c;*

FIG. 9*a* is a partially broken perspective view showing fourth alternative embodiment of a container in accordance with the present invention;

FIG. 9*b* is a bottom plan view of a closure adapted for use with the container embodiment shown in FIG. 9*a;*

FIG. 9*c* is a cross-sectional view taken along the line 9*c*—9*c* of FIGS. 9*a* and 9*b;*

DETAILED DESCRIPTION OF THE PREFERRED EMBODIMENTS

Figure 1:
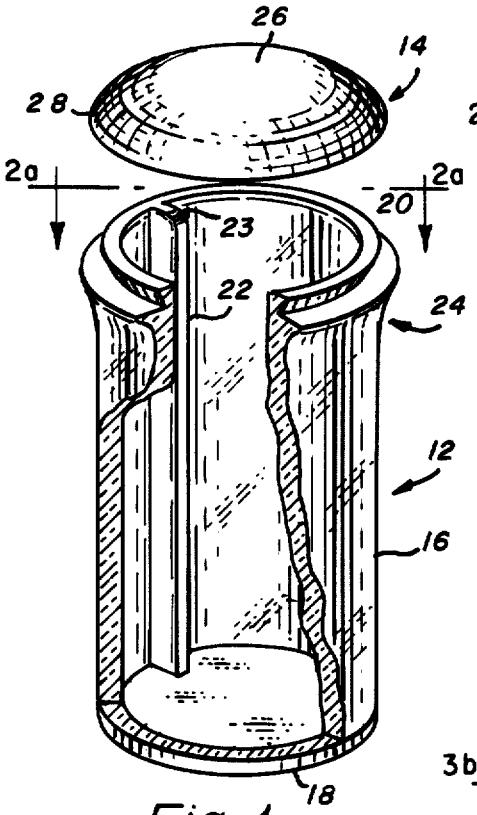

Referring now to FIG. 1 of the drawing, a first embodiment of the present invention is shown to include a container 12 and a closure 14. The container has a generally cylindrical body portion 16 with a closing base portion 18 at its bottom end and is open at its top end to form a mouth 20.

In the plane of mouth opening 20 is an inwardly extending rib 22 forming a fulcrum-bearing surface 23. Surrounding the mouth of the container is a neck portion 24 adapted to mate with the closure 14.

As will be explained in more detail below, the closure is similar to that shown in the above-mentioned Turner patent and includes a top portion 26 and a downwardly depending annular skirt portion 28.

Figure 2A:
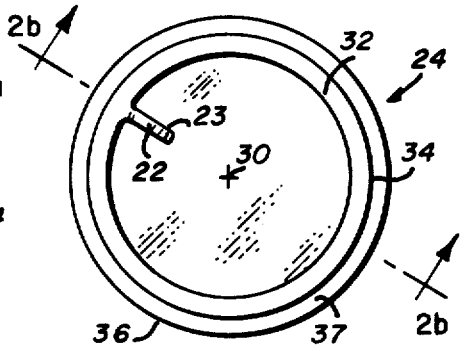
Figure 2B:
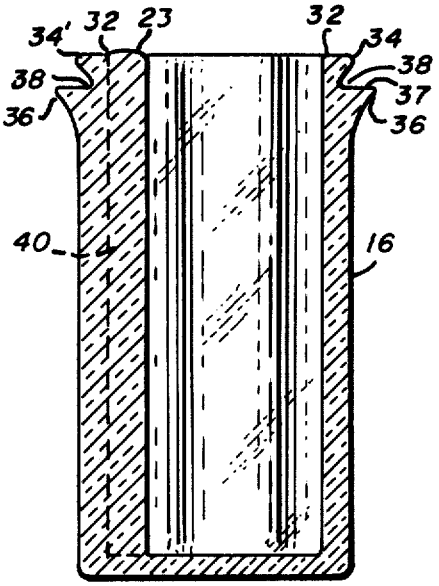

In FIGS. 2*a* and 2*b*, the neck portion and mouth of the container are more clearly illustrated. Note that rib 22 extends radially inwardly towards the center 30 of the container. Neck portion 24 of the container includes an upper extremity 32, an annular lip 34 and a tapered annulus 36 having a flat upper surface 37. The juncture of surface 37 with the lower portion of lip 34 forms an annular locking recess 38.

Rib 22 is shown in FIG. 2*b* as extending radially inwardly a distance equal to several times the thickness of the walls of the cylindrical body portion 16. However, rib 22 may vary in the length of its inward extension depending upon the particular closure designa utilized. The rib can even extend all the way across the container, dividing its internal volume into two separate chambers as will be more fully explained later in the discussion of an alternate embodiment.

Since the primary purpose of rib 22 is to provide the fulcrum-bearing surface 23, it need not extend all the way to the bottom of the container and a portion such as that shown by phantom line 40 may be removed. However, for molding convenience, the rib preferably extends all the way to the container bottom as illustrated.

Figure 3A:
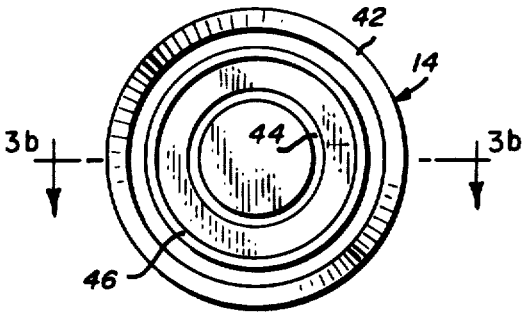

FIG. 3*a* is a bottom plan view of the closure 14. The closure is typically constructed from a resilient material, such as polyethylene, of a suitable density. A high density polyethylene produces a relatively inflexible closure, and a low density polyethylene produces a more pliable closure. The operational safety factor of the closure may be enhanced without changing its shape by selecting a high density polyethylene so as to make it less pliable and thus more difficult for a small child to open.

Figure 3B:
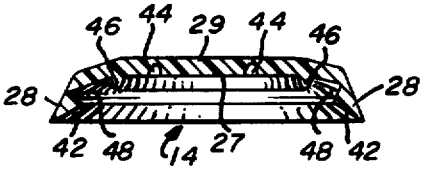

As depicted in FIG. 3*a* and in the cross section of FIG. 3*b*, lower surface 27 of the top portion of the closure 14 has a circular inner groove 44 and an outer groove 48 respectively serving as hinge means joining the circular central part 29 to the annular outer part 31, and as hinge means joining the part 31 to the skirt 28. Also formed on the lower surface of part 31 is an annular bead 46 which, as will be more fully described below, serves as a fulcrum about which a radial segment of part 31 is rotated.

Figure 4:
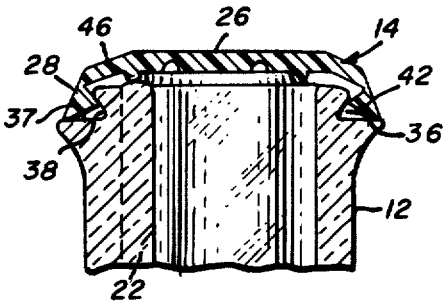

In FIG. 4, closure 14 is shown applied over the mouth of container 12 so that its inwardly-extending locking bead 42 mates with annular recess 38. Note that a portion of the fulcrum bead 46 contacts the top of rib 22 while the rest of the bead does not contact any portion of the container. Note also that the lower edge of the skirt 28 contacts surface 37 and has an outside diameter no greater than that of the outer extremity of surface 37.

When the closure is thus applied to the container, it is virtually impossible for a small child to remove it. More specifically, the closure cannot be easily pried off from below because it is shielded by the tapered portion 36 which lies directly therebeneath. Furthermore, it cannot be twisted or pulled off due to the lack of purchase points. In fact, the only practical method for removing the closure is the forceful application and then release of outside pressure directed downwardly upon the center of top portion 26 as illustrated in FIGS. 5*a*, 5*b* and 5*c*.

Figure 5A:
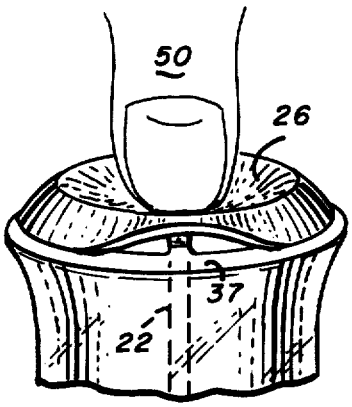
Figure 5B:
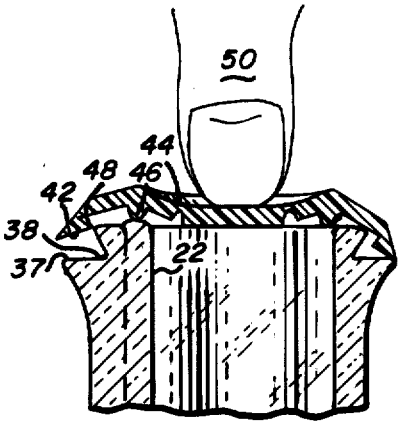
Figure 5C:
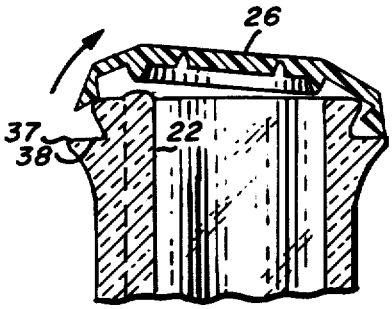

In FIGS. 5*a* and 5*b*, it may be seen that when the top central region of the top portion of the closure is depressed, as by a finger 50, a relatively short segment of the skirt proximate rib 22 is lifted out of the plane defined by the remainder of the skirt portion still in contact with surface 37. This lifting out of plane is the result of the lever and fulcrum action which takes place as the innermost portion of the closure is depressed and the relatively stiff segment of the closure lying between hinge grooves 44 and 48 pivots on the bead 46 to lift the adjacent skirt portion to a position above the locking recess 38 as illustrated in FIG. 5*b*. Upon release of the finger pressure, the closure attempts to return to its original unstressed shape and in so doing, that portion of the skirt now lodged above the recess 38 causes the remainder of the bead 42 to become disengaged from recess 38 as illustrated in FIG. 5*c*. The closure may then be easily removed by lifting.

Referring again to FIG. 5*b*, the dynamics of raising a segment of the skirt out of plane may be more clearly explained. As bead 46 contacts the top surface 23 of rib 22, it acts as the fulcrum for a lever formed by a portion of the closure disposed above the rib and extending between hinge grooves 44 and 48. As the central region of the closure is depressed, the end of the lever arm proximate hinge 44 is lowered and the stiff segment between the hinges pivots about the point of contact of bead 46 with rib 22 and thus raises the end of the lever arm proximate hinge 48 and the portion of the skirt intersected by the line of leverage, thereby lifting the corresponding portion of bead 42 to a disengaged position above recess 38. When the finger pressure is removed and the closure returns to its natural, unstressed shape, the rest of bead 42 is released from engagement with recess 38 as the closure returns to its single plane shape again and it assumes the position of axial misalignment with the container as illustrated in FIG. 5*c*.

Figure 6A:
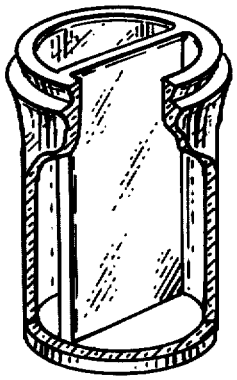

In FIG. 6*a*, an alternative embodiment of a container 112 in accordance with the present invention is shown which is similar in most respects to the previously described container 12 except that instead of having a rib, a web 122 is provided which extends fully across the container's neck opening. In this embodiment, the closure is lifted out of plane at two points around its circumference corresponding to the two points of contact between the annular pivot bead of the closure and the upper surface 123 of the web.

Figure 6B:
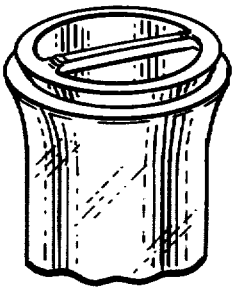

In FIG. 6*b*, a beam or bar 122′ extends across the mouth of a container 112′. Although the beam 122′ does not extend to the bottom of the container to divide the internal volume thereof, its action and function are similar to that of web 122.

Alternatively, the closure may be made to lift its skirt out of plane at more than two points around the container mouth either by forming multiple separate ribs around the interior of the container mouth or by forming a plurality of intersecting, container-dividing, elongated webs within the container. In the latter case, it is contemplated that a web-forming insert could be substituted for the integrally-formed web structure. However, there is a limit to the number of separate ribs utilized, because with greater numbers of ribs formed around the mouth of the container, the facility for deforming the skirt out of plane is reduced.

Figure 7:
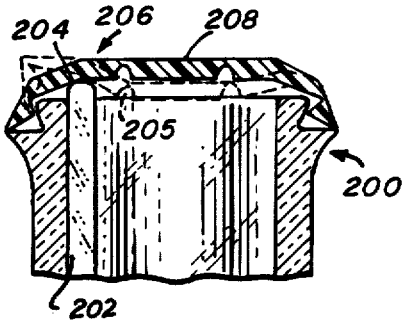

In FIG. 7, still another alternative embodiment for a container and closure in accordance with the present invention is shown. In this embodiment, the container 200 is identical to that shown in FIG. 1 and has a rib 202 that forms a fulcrum-bearing surface 204. The closure 206 is similar in structure to previously discussed closures except that it has no annular pivot bead provided on its underside. The theory of operation of this embodiment closely parallels the previous discussion of the operation of the preferred embodiment, except that since no pivot bead is provided, the geometrical relationship of the underside of the closure hinge groove 205 and the rib 202 may change slightly from that of the previous description.

Figure 8A:
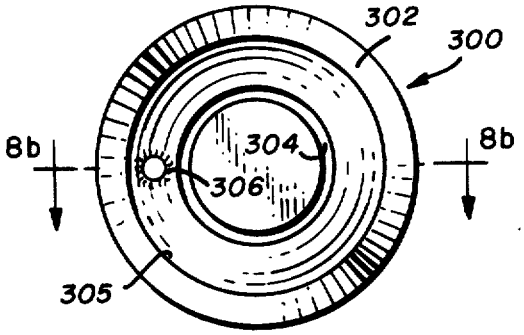
Figure 8B:
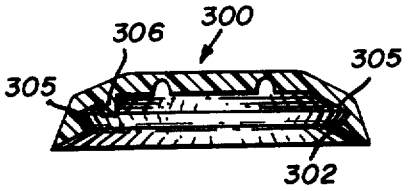

In FIGS. 8*a* and 8*b*, a further alternative embodiment for a closure with enhanced safety features is shown. In this embodiment, closure 300 is provided with a locking bead 302, hinge grooves 304 and 305, and a single downwardly-extending pivot member 306 formed as indicated on the underside of the closure. In this embodiment, unless pivot member 306 is properly aligned so as to contact the top of a container rib, the closure cannot be removed. Thus, to remove the closure from a container, it is necessary to first rotate the closure relative to the container (while bead 302 is still lockingly engaged to the container) until the pivot member 306 is aligned with the rib. Then the closure may be opened in the manner described above. As an aid to alignment, marks or other indicia are usually provided on the skirt of the closure and on the neck of the container.

Figure 8C:
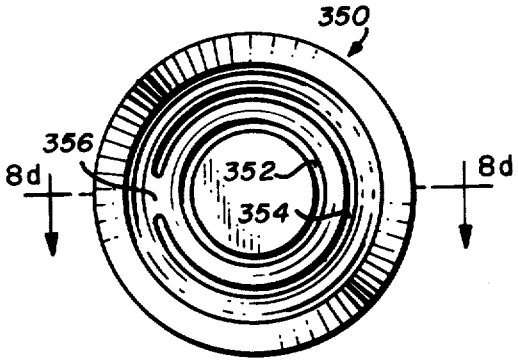
Figure 8D:
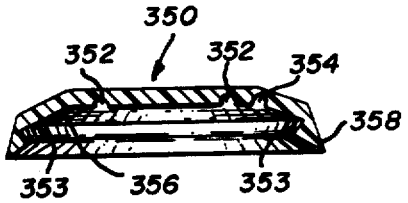

In FIGS. 8*c* and 8*d*, another alternative embodiment for a closure 350 with enhanced safety features is shown. This closure, which is the functional complement of the embodiment shown in FIGS. 8*a* and 8*b*, includes the usual inner hinge groove 352 and outer hinge 353, and located between them is a partially circumscribing additional hinge groove 354 which is discontinuous at a lever portion 356. The closure of this embodiment may only be removed when the ungrooved lever portion 356 is aligned with the container rib and its unweakened stiffness serves to lift the adjacent portion of the depending skirt 358 out of plane. The closure will not release except when lever portion 356 is aligned with the rib because otherwise hinge 354 defeats any lever-like action.

Figure 9A:
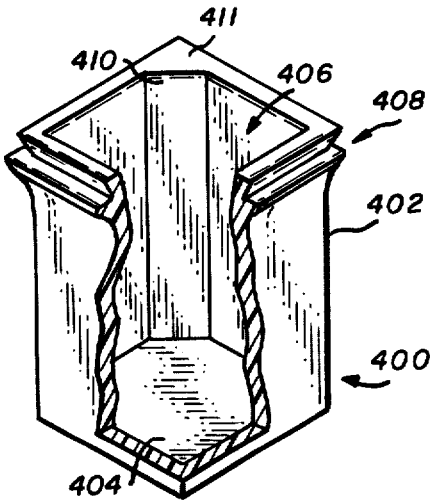
Figure 9B:
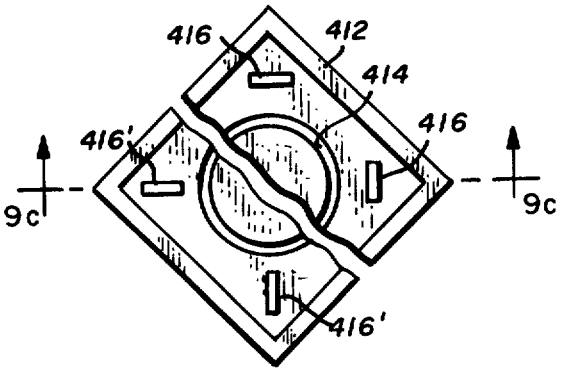
Figure 9C:
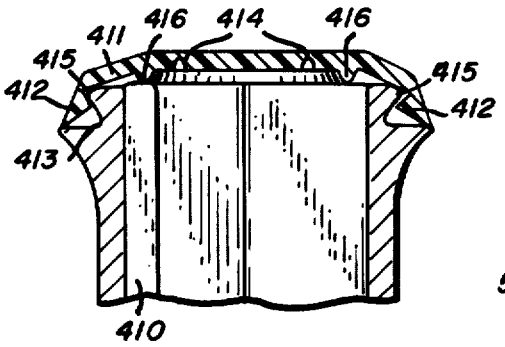

FIGS. 9*a*, 9*b* and 9*c* depict still another alternative embodiment of a container and closure to illustrate one of the many noncylindrical container shapes possible. In this embodiment, container 400 has a generally rectangularly-shaped body portion 402 which is closed at 404 and has an open mouth 406. A neck portion 408 surrounding the mouth is of similar cross-sectional appearance to the neck portions of the previously described embodiments. Integrally formed at the juncture of two walls is a fillet-like rib 410 which provides a fulcrum-bearing surface 411 as in the previously described embodiments.

In FIGS. 9*b* and 9*c*, the underside of a rectangularly-shaped closure is shown to include an inwardly projecting locking bead 412, an inside hinge-forming groove 414, an outer hinge-forming groove 415, and four downwardly extending pivot-forming members 416, each of which is formed near a corner of the closure. It is, of course, to be appreciated that the pivot members may either be tangentially oriented as illustrated at 416 or radially oriented as shown as 416'.

The use and operation of the container and closure of this embodiment is again similar to those previously disclosed. When downward pressure is applied to the top central portion of the closure, a pivot member 416 engages the surface 411 and acts as a fulcrum for the lever portion of the closure extending between hinges 414 and 415, thereby causing the corner of the closure disposed above rib 410 to be lifted out of plane, forcing bead 412 out of engagement with the container's locking recess 413.

Figure 10:
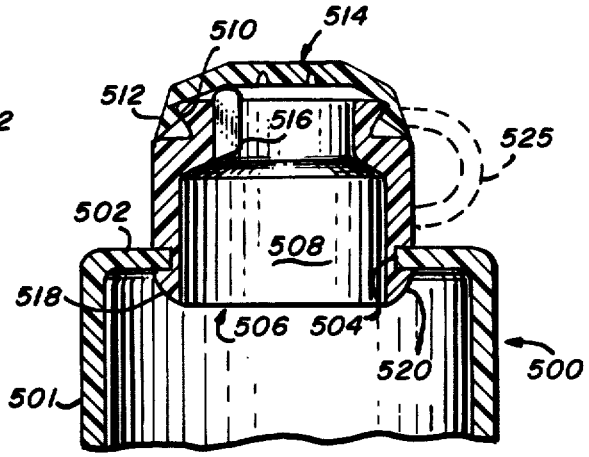
FIG. 10 is a partial cross-sectional view of another alternative embodiment of a container and closure in accordance with the present invention.

A further alternative embodiment is shown in FIG. 10 to illustrate the use of means in accordance with the present invention as an insert to provide a security aperture for the walls of other, nonmonolythic surfaces such as with the container illustrated at 500. The container 500, which might for example, take the form of a metal can, has a body portion 501 and a top portion 502 in which an aperture 504 is formed. In this case, an insert 506 having features of the present invention forms the neck of the container and receives a closure 514. A strap 525, shown here in phantom view, may also be provided to capture the closure to prevent its loss as well as to provide a self-opening feature.

Figure 11:
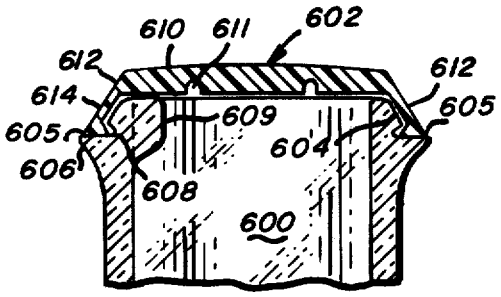
FIG. 11 is a partial cross-sectional view showing an alternative locking configuration in accordance with the present invention.

In FIG. 11, a slightly different configuration of container 600 and closure 602 is illustrated wherein the container neck is configured to have a frusto-conical surface 604 provided above the top surface 605 of the shielding flange 606, and the annular locking recess 608 is located in the surface 604 at its junction with surface 605. A lifting rib or projection 609 is provided on the inside wall of container 600 as in previously described embodiments. The closure 602 is constructed with a relatively thick upper portion 610 and a relatively thin, frustoconically tapered skirt portion 612. Note that the principal difference between the closure of this embodiment and those of the previously described embodiments is that the width of the outer groove (see 48 in FIG. 3*b*, for example) has been enlarged to extend axially over almost the entire length of the skirt 612, thereby forming a skirt wall which is thinner than the thickness of the upper portion 610. An annular hinge groove 611 is provided in the upper portion 610 as in previously described embodiments.

In this embodiment, a narrow locking bead 614 is provided on the inside wall of the skirt 612 at its lower expremity. It will, of course, be appreciated that for particular applications, the bead 614 might instead be a groove and the groove 608 might instead be a bead.

Figure 12:
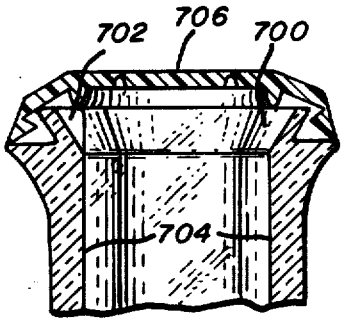
FIG. 12 is a partial cross-sectional view showing an alternative container mouth configuration in accordance with the present invention.

In FIG. 12, still another embodiment is illustrated which includes a container neck inside wall segment 700 that is frusto-conically tapered as indicated. In this embodiment the rib 702 extends radially inwardly from the wall segment 700 to a point flush with the main cylindrical wall 704 of the container. Other details of the container are as previously described, and the closure 706 may take any appropriate form described or suggested above.

An important advantage of this embodiment is that even though an inwardly extending rib is provided at the mouth of the container, no obstruction enters the cylindrical volume of space defined by the main body of the container. Such advantage will of course be apparent to those skilled in the art.

Although the present invention has been described above with reference to several particular embodiments, it is understood that modifications thereof will no doubt become apparent to those skilled in the art after having read this disclosure. It is therefore intended that the appended claims be interpreted as covering all such modifications as fall within the true spirit and scope of the invention.

What is claimed is:

1. An improved security container and closure apparatus comprising:

container means including a neck portion having a circumscribing first locking means formed in its outer surface proximate a mouth-forming end thereof, a circumscribing flange means provided adjacent and beneath said first locking means and having a first outside diameter, means projecting radially inwardly from a relatively small circumferential segment of said neck portion and forming a bearing surface that extends into said mouth; and resilient closure means including a top portion having an upper surface and a lower surface, and a circumscribing, downwardly-depending skirt portion having a second locking means formed on an inside surface thereof for matingly engaging said first locking means, said skirt portion having a lower extremity of a second outside diameter equal to or less than said first diameter and lying in a single plane, whereby when said closure means is positioned to lockingly close said mouth, said first locking means mates with said second locking means to lock said closure means to said container means, and whereby removal of said closure means from said container means is effected by applying a downward force to a central part of said upper surface sufficient to deform said top portion downwardly such that only the part thereof lying over said bearing surface engages said bearing surface and pivots thereabout to lift a contiguous relatively small circumferential segment of said skirt portion upwardly and out of said single plane such that the resiliency of said skirt portion causes the unlifted portion thereof to cam upwardly over said first locking means as said downward force is relieved.

2. An improved security container and closure apparatus as recited in claim 1 wherein said container means is cylindrical in shape and said projecting means is a radially extending rib, the upper end of which forms said bearing surface.

3. An improved security container and closure apparatus as recited in claim 2 wherein said rib extends radially inwardly into said mouth just far enough for the upper surface thereof to be engaged by said inner surface at a point sufficient to provide an adequate lever arm for lifting said part of said skirt portion.

4. An improved security container and closure apparatus as recited in claim 1 wherein said projecting means extends all the way across said mouth.

5. An improved security container and closure apparatus as recited in claim 1 wherein a downwardly extending bead means is provided on said inner surface for engaging said bearing surface and serving as a fulcrum about which said overlying part is pivoted.

6. An improved security container and closure apparatus as recited in claim 5 wherein said bead means circumscribes a central part of said top portion.

7. An improved security container and closure apparatus as recited in claim 5 wherein said bead means lies along a small segment of a line circumscribing a central part of said top portion, whereby said closure can only be removed when it is aligned relative to said container such that said bead means overlies said bearing surface.

8. An improved security container and closure apparatus as recited in claim 1 wherein said top portion has a first annular groove provided in said lower surface and circumscribing a central part thereof, said groove acting as a hinge for facilitating the pivoting of said overlying part about said bearing surface.

9. An improved security container and closure apparatus as recited in claim 8 wherein a second groove is provided in said lower surface at its junction with said skirt portion so as to act as another hinge for facilitating the pivoting of said overlying part about said bearing surface.

10. An improved security container and closure apparatus as recited in claim 9 wherein a third annular groove is provided in said lower surface discontinuously circumscribing said first groove, the part of said top portion lying at the discontinuity and between the ends of said third groove, being the only part of said top portion which will permit removal of said closure when it overlies said bearing surface.

11. An improved security container and closure apparatus as recited in claim 1 wherein said container means is generally rectangular in transverse cross section and said projecting means is formed at the intersection of two side walls of the container.

12. An improved security container and closure apparatus as recited in claim 1 wherein said container means has a generally cylindrical inside wall and said projecting means is a narrow radially and longitudinally extending rib formed integral with said inside wall.

13. An improved security container and closure apparatus as recited in claim 1 wherein said outer surface of said neck portion is frusto-conically configured.

14. An improved security container and closure apparatus as recited in claim 12 wherein said first locking means includes an annular groove formed in said outer surface.

15. An improved security container and closure apparatus as recited in claim 14 wherein said skirt portion has a thickness less than that of said top portion and said second locking means includes an annular bead formed on the inside surface thereof for mating with said annular groove.

16. An improved security container and closure apparatus as recited in claim 1 wherein the inner wall of said neck portion is frusto-conically flared outwardly and said projecting means projects inwardly no further than the lowermost circumference of the flared neck portion.

17. An improved security container and closure apparatus as recited in claim 1 wherein said container means has a generally cylindrical inner wall that is flared outwardly at said mouth-forming end.

18. An improved security container and closure apparatus as recited in claim 17 wherein said projecting means extends inwardly from the flared portion no further than said inner wall.

* * * * *